US005787731A

United States Patent [19]

Ebara

[11] Patent Number: 5,787,731

[45] Date of Patent: Aug. 4, 1998

[54] PERSONAL ORNAMENT

[76] Inventor: Isao Ebara, 5-14-506, Sanban-cho, Chiyoda-ku Tokyo, Japan

[21] Appl. No.: 754,446

[22] Filed: Nov. 19, 1996

[51] Int. Cl.[6] ..... A44C 17/02

[52] U.S. Cl. ..... 63/29.1; 63/15

[58] Field of Search ..... 63/15, 15.7, 26, 63/27, 29.1, 29.2, 31

[56] References Cited

U.S. PATENT DOCUMENTS

| | | | |
|---|---|---|---|
| 2,497,207 | 2/1950 | Burk | 63/15.7 |
| 2,585,183 | 2/1952 | Stern | 63/15 |
| 4,854,133 | 8/1989 | Irwin | 63/15 |
| 5,433,090 | 7/1995 | Santiago | 63/29.1 |
| 5,588,310 | 12/1996 | Lai | 63/15 |

*Primary Examiner*—Kien T. Nguyen
*Attorney, Agent, or Firm*—Jordan and Hamburg

[57] ABSTRACT

A personal ornament of the present invention is capable of the usage by the condition in corresponding to the interest of the users and a time, place or object which is used it by them. A part of a support member of a ring shape is lacked of limit. The body of revolution which is pivotally mounted on the opening part of the support member which has decorated parts with a plural of gemstones or decorated figures at outward circumferential part in the body of revolution is made to be able to arrest certainly a voluntary rotative part.

12 Claims, 25 Drawing Sheets

PERSONAL ORNAMENT

BACKGROUND OF THE INVENTION

This invention relates generally to personal ornaments including a ring, necklace, pendant, earring, bracelet, brooch, tie holder, or cuff links.

A significant disadvantage associated with the usual personal ornaments listed above was, that by mounting gemstones in the support member which is equipped with a chain or ring part put on a person's finger, the gemstones were always displayed in a fixed condition.

Since the personal ornaments including a ring, necklace, pendant, earring, bracelet, brooch, tie holder, or cuff links in which gemstones are fixedly mounted to the support member to create a single design, there were problems when people would need a variety of different personal ornaments corresponding to a time, place or matching object of use; they might lose interest in the personal ornaments; and economically inefficient because the personal ornaments are not used for a long period of time.

SUMMARY OF THE INVENTION

Accordingly, among the several objects of the present invention are the provision of a personal ornament which is capable of entertaining use by exposing gemstones or decorated figures corresponding to the interest of user or a time, place or object that they use; the provision of such personal ornament which is capable of economical usage without having people lose their interests in it during a short period of time; the provision of such personal ornament which is durable; and the provision of such personal ornament which is capable of use without such personal ornament being broken during a long period of a time.

The novel features which are believed to be characteristic of the invention, both as to its organization and method of operation, together with further objects and advantages thereof, will be better understood from the following description considered in connection with accompanying drawings in which a presently preferred embodiment of the invention is illustrated by way of example. It is to be expressly understood, however, that the drawings are for the purpose of illustration and description only, and are not intended as a definition of the limits of the invention.

DETAILED DESCRIPTION OF THE INVENTION

Preferred embodiments of the present invention will be described in more detail below, referring to the accompanying drawings.

An understanding of the present invention may be best gained by reference to FIGS. 1 to 7. FIGS. 1 to 7 illustrate a personal ornament of the first embodiment of the present invention. A personal ornament 1 as a ring comprises a support member assembly 3 and a body of revolution assembly 4.

The support member assembly 3 forms a shape of a ring, having an opening part 2 conveniently formed by cutting off a part thereof, which can be worn on one of a person's fingers. The body of revolution assembly 4 is a rectangular shape having at least two faces, and which is rotatably mounted to the opening part 2 in the support member assembly 3.

Figure 1:
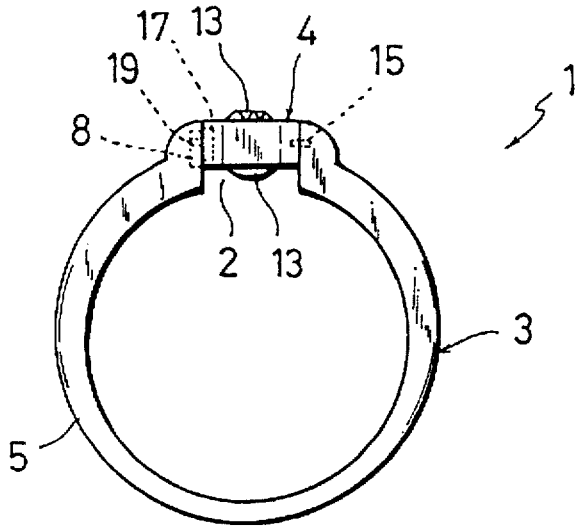
FIG. 1 is a front view showing the first embodiment of the present invention.
Figure 2:
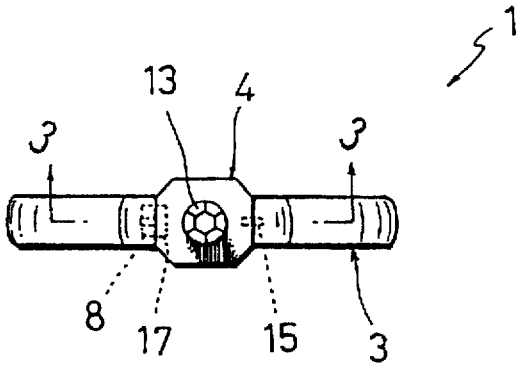
FIG. 2 is a plan view showing the first embodiment of the present invention.
Figure 3:
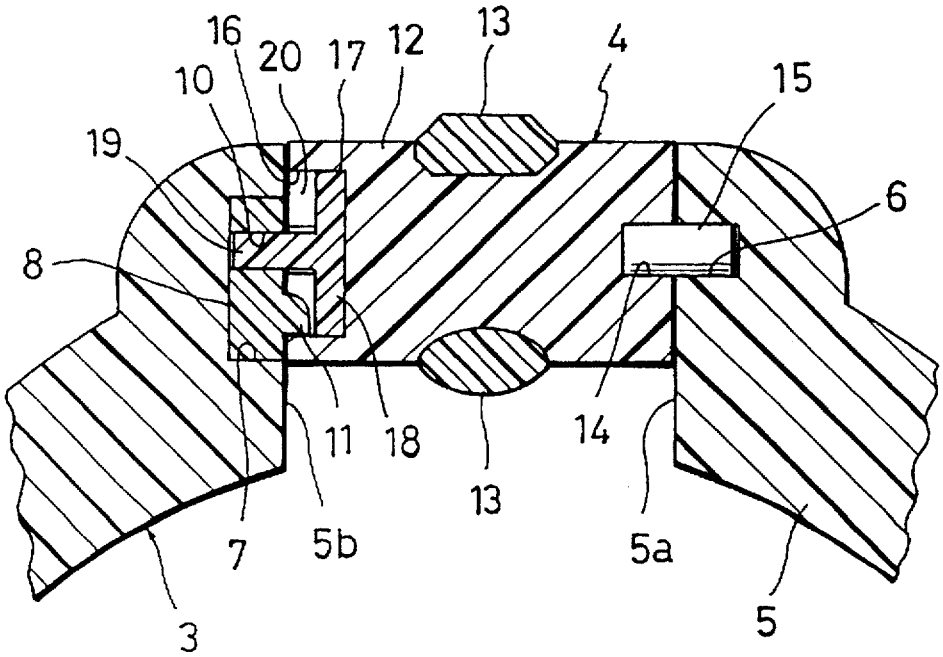
FIG. 3 is an expanded sectional view taken through line 3—3 showing of FIG. 2.
Figure 4:
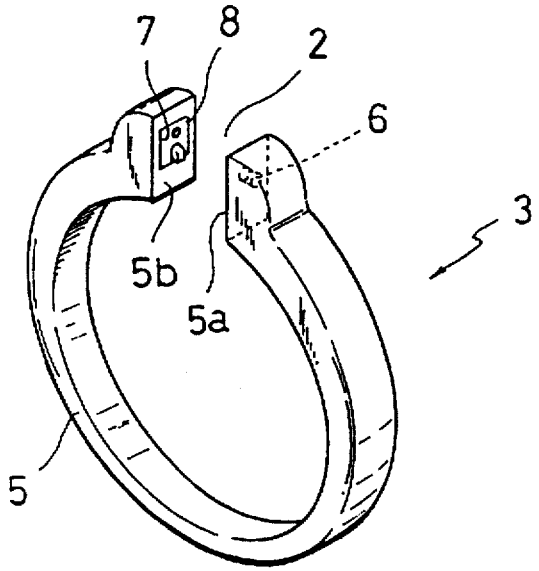
FIG. 4 is an explanation view of a support member showing the first embodiment of the present invention.
Figure 5:
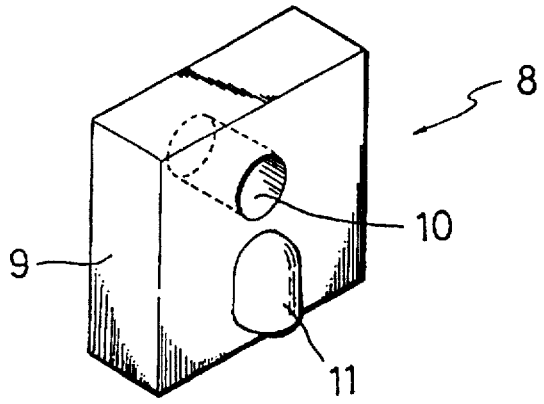
FIG. 5 is an explanation view of a bearing member showing the first embodiment of the present invention.

The support member assembly 3 shown in FIG. 4 comprises a support member 5, one of bearing hole 6, a rectangular concave part 7, and a bearing member assembly 8. The support member assembly 5 with opening part 2 is made of precious metal material having elasticity including gold of eighteen carat or a plated metallic material. One of bearing hole 6 is formed at one of end part 5*a* of the opening part 2 in the support member 5. In addition, a rectangular concave part 7 is formed at another end part 5*b* of the opening part 2 in the support member 5. Moreover, the bearing assembly 8 is fixedly embedded into the concave part 7 by press-fit insertion or using adhesives.

A bearing member assembly 8 is made of materials including titanium or stainless which are superior to wear and which are rust resistant. This bearing member assembly 8 shown in FIG. 5 comprises a bearing member 9, another bearing hole 10 and an arresting projection 11. The bearing member 9 is laid inside the concave part 7. Another bearing hole 10 is placed in the part corresponding to one of bearing hole 6 formed the bearing member 9. In addition, the arresting projection 11 is arranged at the outward circumferential part of another bearing hole 10.

Figure 6:
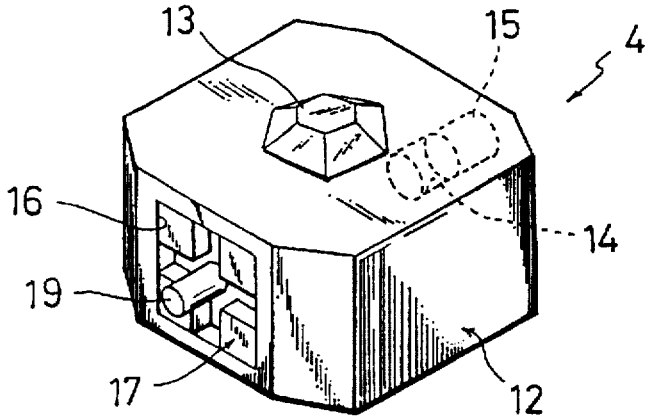
FIG. 6 is an explanation view of a body of revolution showing the first embodiment of the present invention.
Figure 7:
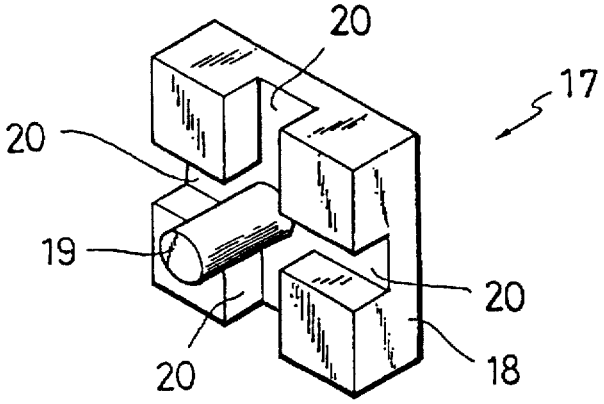
FIG. 7 is an explanation view of an axle member showing the first embodiment of the present invention.
Figure 8:
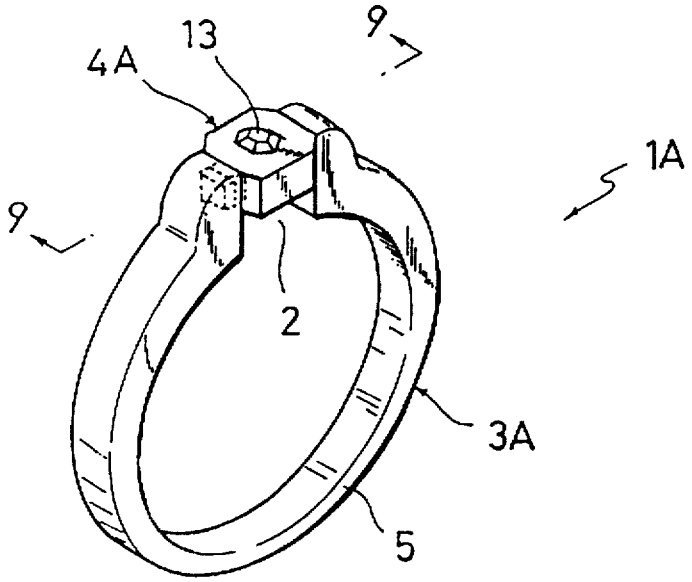
FIG. 8 is a perspective view showing the second embodiment of the present invention.
Figure 9:
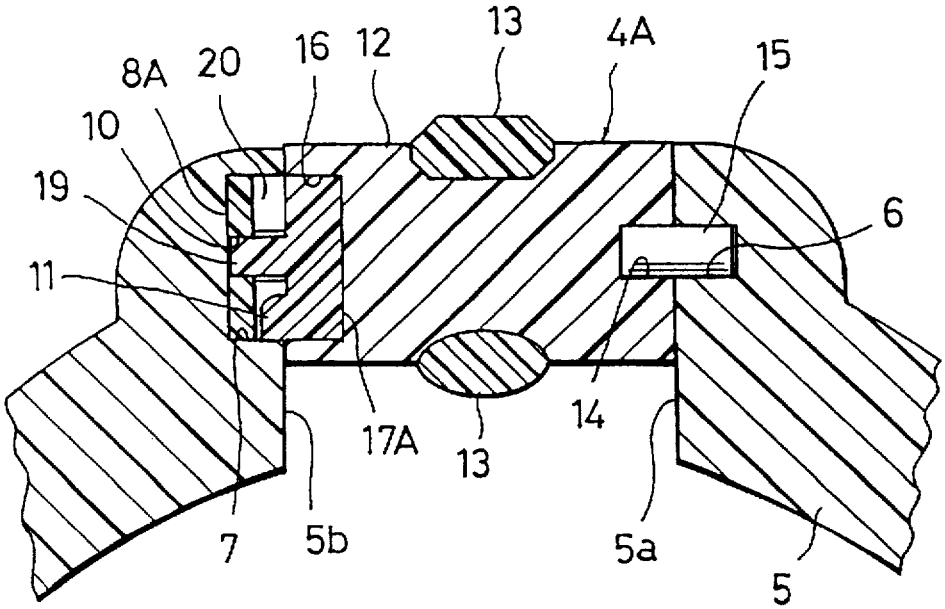
FIG. 9 is an expanded sectional view taken through line 9—9 showing of FIG. 8.
Figure 10:
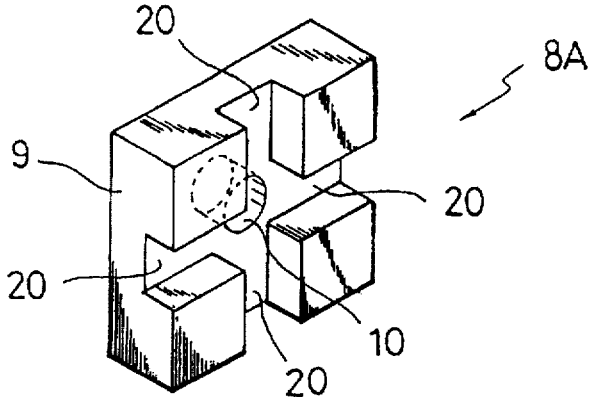
FIG. 10 is an explanation view of a bearing member showing the second embodiment of the present invention.
Figure 11:
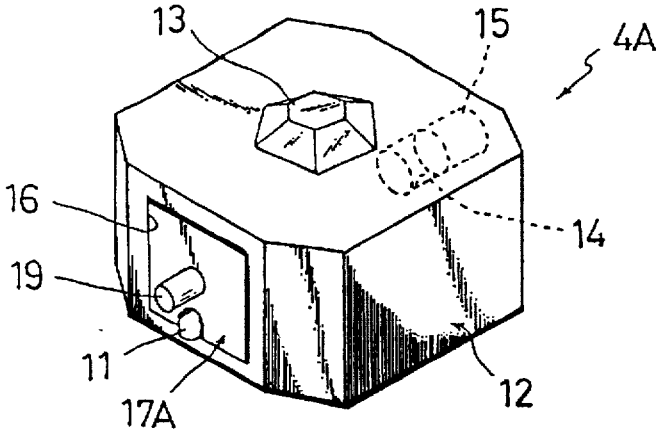
FIG. 11 is an explanation view of a body of revolution showing the second embodiment of the present invention.
Figure 12:
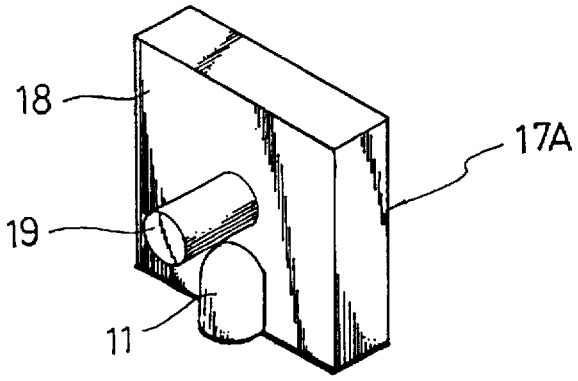
FIG. 12 is an explanation view of an axle member showing the second embodiment of the present invention.
Figure 13:
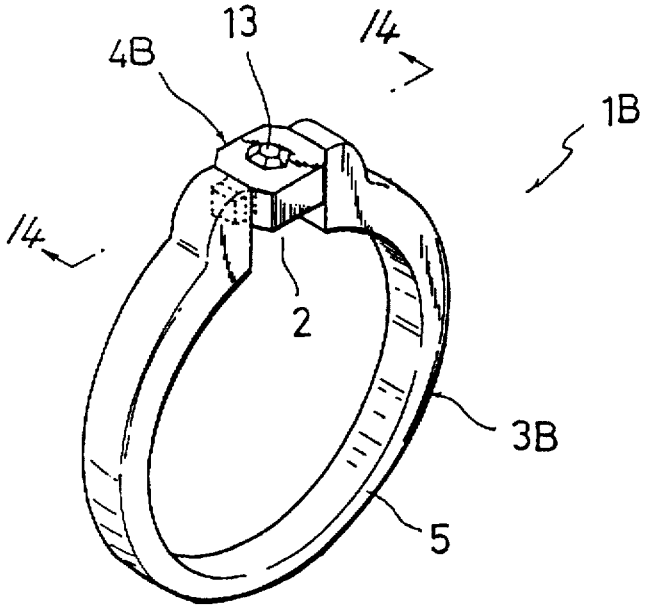
FIG. 13 is a perspective view showing the third embodiment of the present invention.
Figure 14:
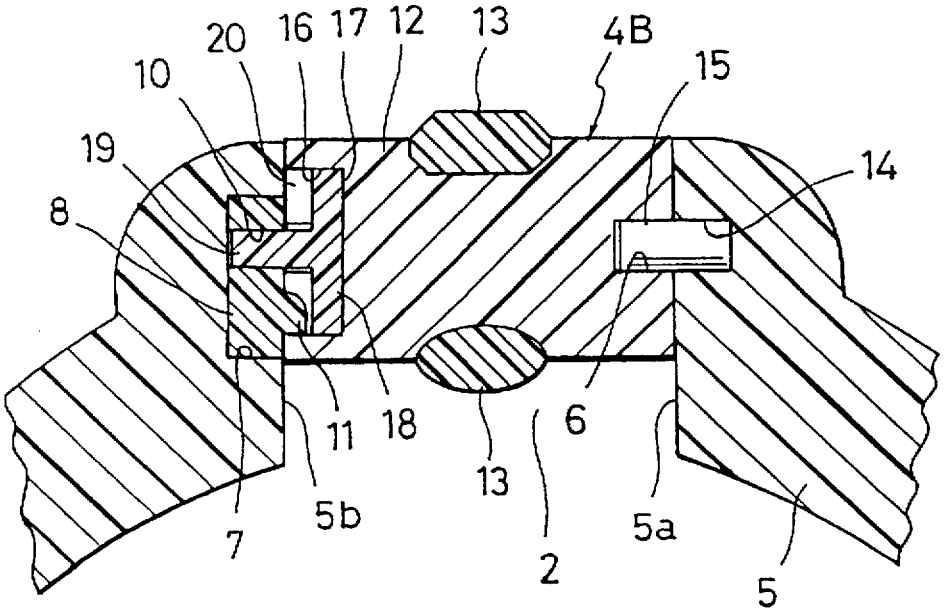
FIG. 14 is an expanded sectional view taken through line 14—14 showing of FIG. 13.
Figure 15:
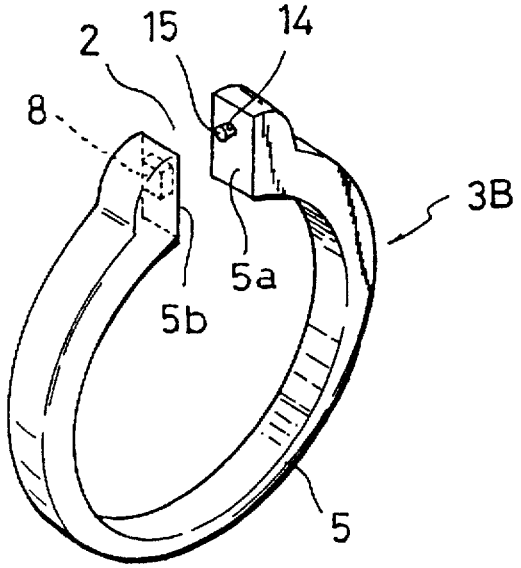
FIG. 15 is an explanation view of a support member showing the third embodiment of the present invention.
Figure 16:
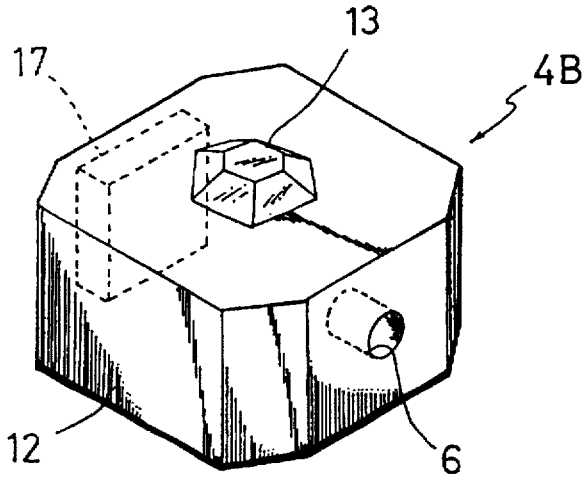
FIG. 16 is an explanation view of a body of revolution showing the third embodiment of the present invention.

The body of revolution assembly 4 shown in FIG. 6 comprises a body of revolution 12, decorative parts 13, 13, one of axle 15, a rectangular concave part 16 and an axle member 17. The body of revolution 12 is made of metallic material including eighteen carat gold or white gold with a rectangular shape. The decorative parts 13, 13 including gemstones such as a diamond, ruby, sapphire, emerald, topaz or amethyst or pearl are mounted on the upper and lower faces of the body of revolution 12. One of axle 15 is rotatably supported to one of bearing hole 6. One of bearing hole 6 is inserted with pressing with the bearing hole 14 to the fixed condition at side face in corresponding to one of bearing hole 6 at the body of revolution 12. The rectangular concave part 16 is formed at a side face of the body of revolution 12 corresponding to the bearing member assembly 8. In addition, the axle member 17 is fixedly imbedded into the concave part 16 by press-fit insertion or by means of adhesives.

An axle member assembly 17 is made of materials including titanium or stainless which are superior to wear and which are rust resistant. This axle member assembly 17 shown in FIG. 7 comprises an axle member 18, another axle 19 and the arresting slots 20, 20, 20 and 20. The axle member 18 is laid into the concave part 16. Another axle 19 is rotatably supported by another bearing hole 10 which is located at the part in corresponding to another bearing hole 10 formed at the axle member 18. The arresting slots 20, 20, 20 and 20 as four engagement holes are fixed with the arresting projection 11 which is arranged circumferentially outward of another axle 19 at ninety degree increments.

In the above referred personal ornament 1, the body of revolution assembly 4 can be rotated pivotally by one of axle 15 and another axle 19 as fulcrum, and the arresting projection 11 fixes either of arresting slots 20, 20, 20 and 20 when the body of revolution assembly 4 rotates ninety degrees, and it can be arrested at any place. Then, the user can orient the favorite decorations 13, 13 at the surface in accordance with the user's taste or corresponding to the demands of a time, place, or object. Therefore the user uses to wear it on one of their fingers into the support member assembly 3 by its condition.

Other embodiments of the present invention will now be described referring to FIGS. 8 to 50. Throughout the drawings of the embodiments, like components are denoted by like numerals as of the first embodiment and will not therefore be explained in greater detail.

FIGS. 8 to 12 illustrate the second embodiment of the present invention which is distinguished from the first embodiment by the fact that the support member assembly 3 is replaced with another like assembly 3A and the body of revolution assembly 4 is replaced with another like assembly 4A. The support member assembly 3A comprises the support member 5 fixed with the bearing member assembly 8A in which is formed four engagement slots 20, 20, 20 and 20 circumferentially outward of another bearing hole 10. In addition, the body of revolution assembly 4A comprises of the body of revolution 12 fixed to the axle member 17A which forms the arresting projection 11 at outward circumferential part of another axle 19. Accordingly, a personal ornament 1A with the support member assembly 3A and the body of revolution assembly 4A according to the second embodiment will provide the same function as of the first embodiment.

FIGS. 13 to 16 illustrate the third embodiment of the present invention which is distinguished from the first embodiment by the fact that the support member assembly 3 is replaced with another like assembly 3B and the body of revolution assembly 4 is replaced with another like assembly 4B. The support member assembly 3B is fixed to one of axle 15 with the press-fit insertion, and the bearing hole 14 being disposed at one of end part 5*a* in the opening part 2 of the support member 5. The body of revolution assembly 4B has formed therein one of bearing hole 6 which rotatably supports one of axle 15 at a side face of a body of revolution 12. Accordingly, a personal ornament 1B with the support member assembly 3B and the body of revolution assembly 4B according to the third embodiment will provide the same function as the first embodiment.

Figure 17:
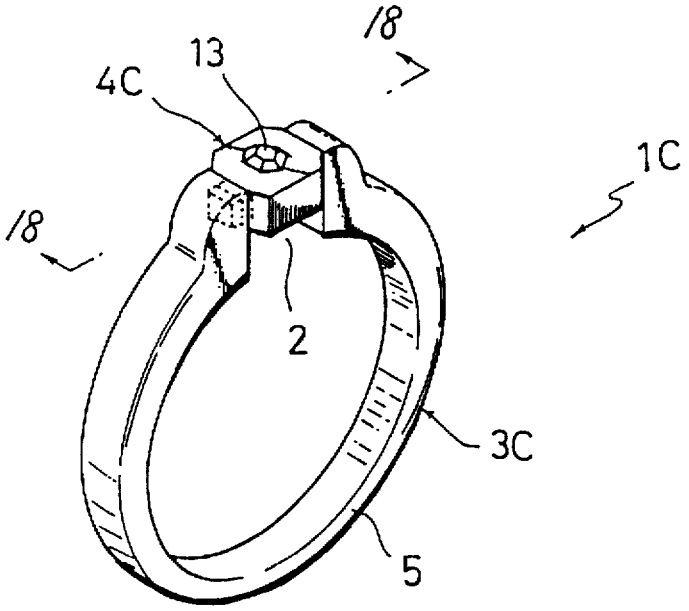
FIG. 17 is a perspective view showing the fourth embodiment of the present invention.
Figure 18:
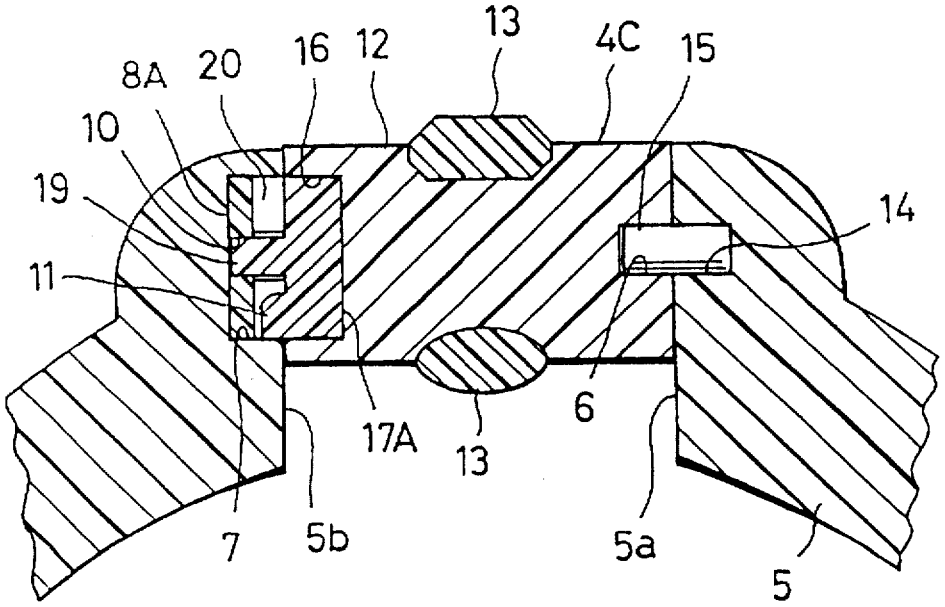
FIG. 18 is an expanded sectional view taken through line 18—18 showing of FIG. 17.

FIGS. 17 to 18 illustrate the fourth embodiment of the present invention which is distinguished from the first embodiment by the fact that the support member assembly 3 is replaced with another like assembly 3C and the body of revolution assembly 4 is replaced with another like assembly 4C. The support member assembly 3C is fixed to the one of axle 15 by press-fit insertion, and the bearing hole 14 at an end part 5*a* in the opening part 2 of support member 5. The body of revolution assembly 4C has formed therein one of bearing hole 6 which rotatably supports one of axle 15 at a side face of the body of revolution 12. Accordingly, a personal ornament 1C with the support member assembly 3C and the body of revolution assembly 4C according to the fourth embodiment will provide the same function as the second embodiment.

Figure 19:
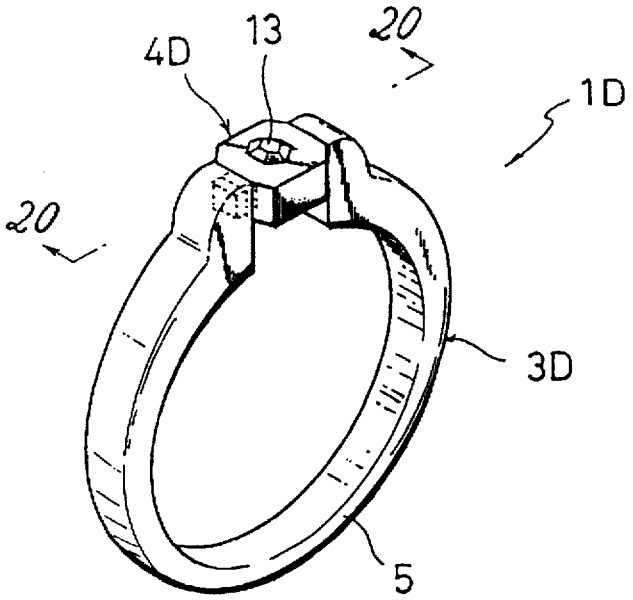
FIG. 19 is a perspective view showing the fifth embodiment of the present invention.
Figure 20:
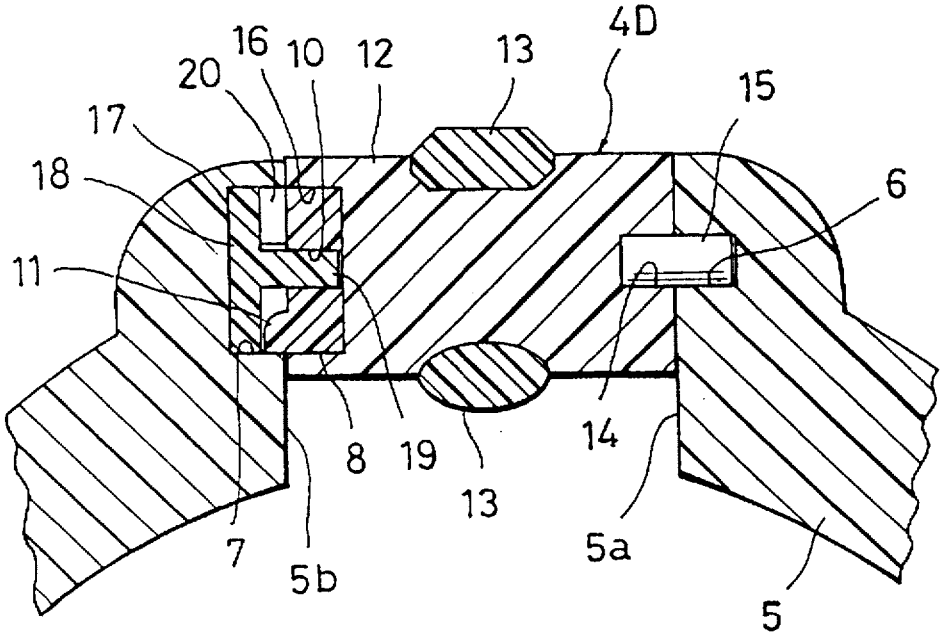
FIG. 20 is an expanded sectional view taken through line 20—20 showing of FIG. 19.

FIGS. 19 to 20 illustrate the fifth embodiment of the present invention which is distinguished from the first embodiment by the fact that the support member assembly 3 is replaced with another like assembly 3D and the body of revolution assembly 4 is replaced with another like assembly 4D. The support member assembly 3D is fixed to the axle member 17A with an embedding of such within the concave part 7 of in the support member 5. In addition, the body of revolution assembly 4D is fixed to the bearing member assembly 8 which embedded within the concave part 16 of the body of revolution 12. Accordingly, a personal ornament 1D with the support member assembly 3D and the body of revolution assembly 4D according to the fifth embodiment will provide the same function as the first embodiment.

Moreover, in this fifth embodiment, the body of revolution assembly may be used it which is formed of one of bearing hole 6 at the body of revolution 12, and fixed to one of axle 15 on the support member 5 by insertion with pressing.

Figure 21:
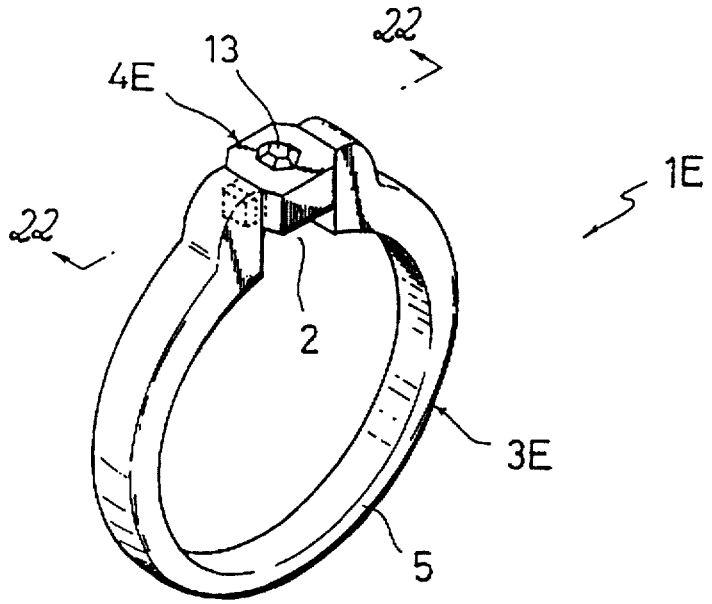
FIG. 21 is a perspective view showing the sixth embodiment of the present invention.
Figure 22:
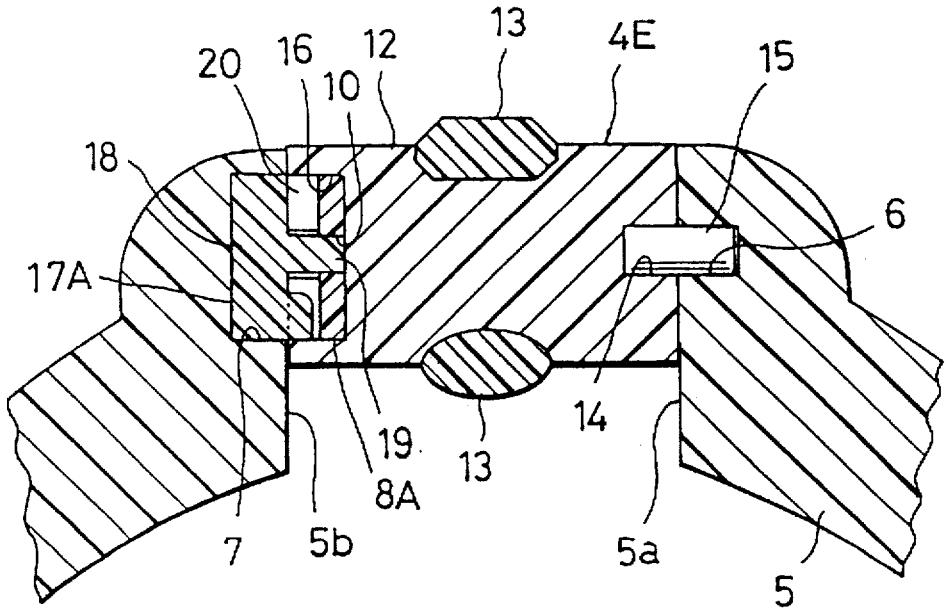
FIG. 22 is an expanded sectional view taken through line 22—22 shown in FIG. 21.
Figure 23:
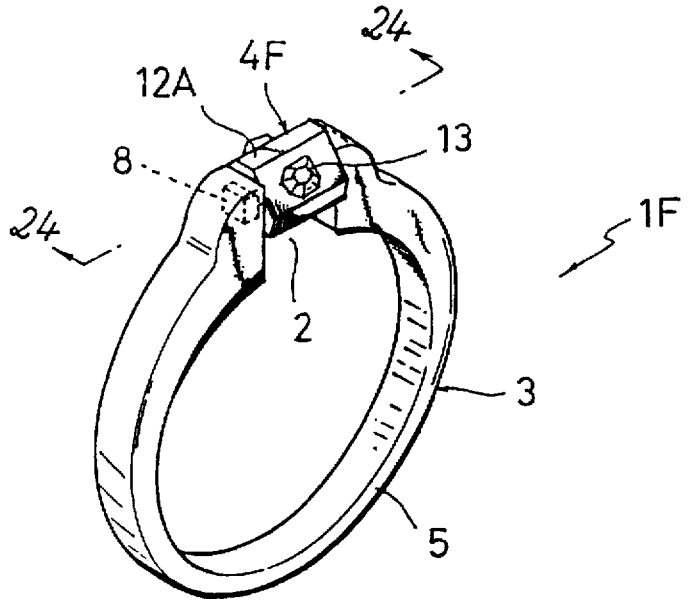
FIG. 23 is a perspective view showing the seventh embodiment of the present invention.
Figure 24:
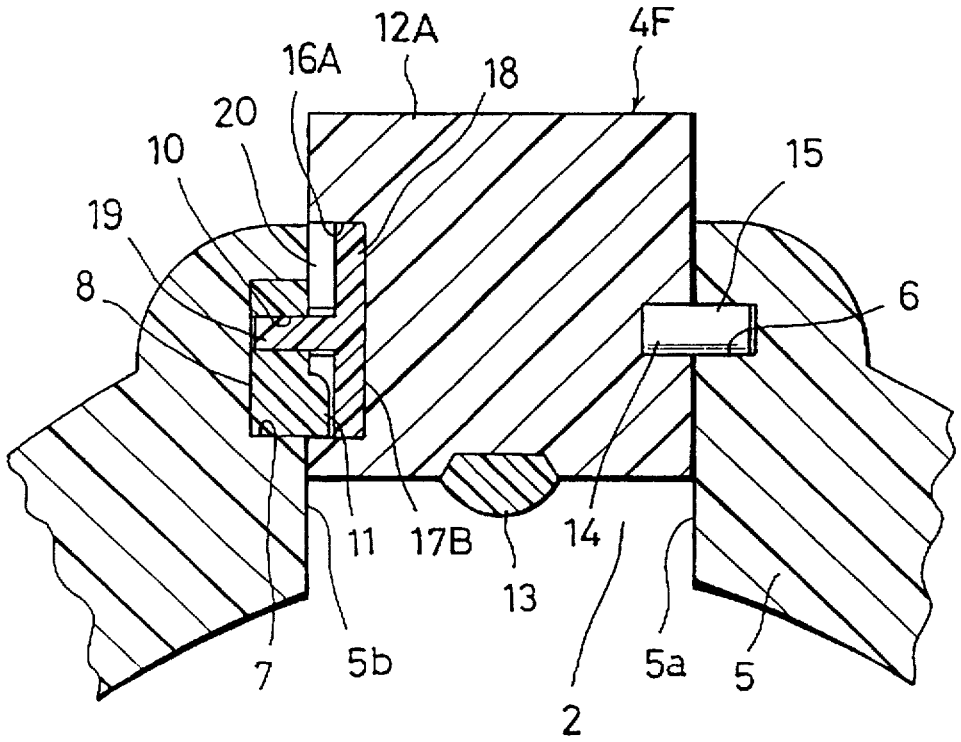
FIG. 24 is an expanded sectional view taken through line 24—24 shown in FIG. 23.
Figure 25:
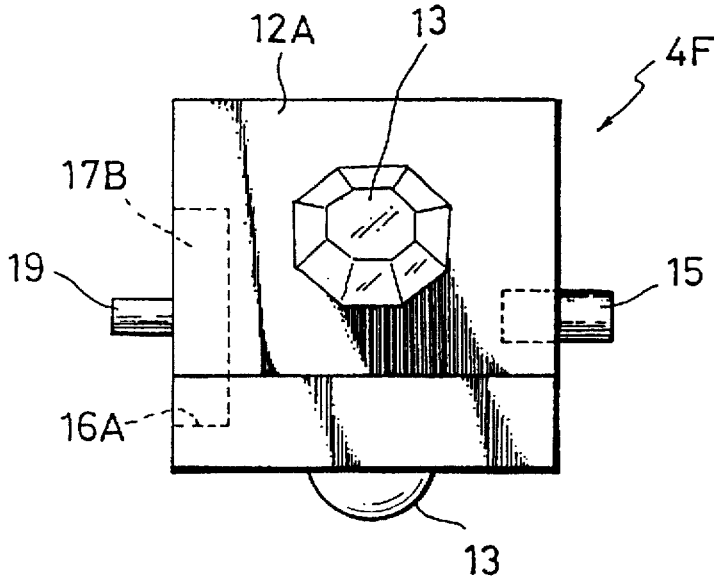
FIG. 25 is a front view of a body of revolution showing the seventh embodiment of the present invention.
Figure 26:
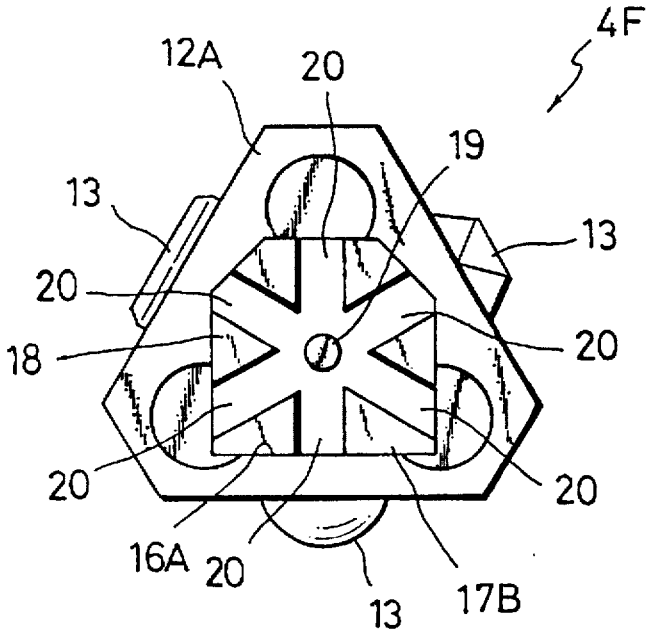
FIG. 26 is a side view of a body of revolution showing the seventh embodiment of the present invention.
Figure 27:
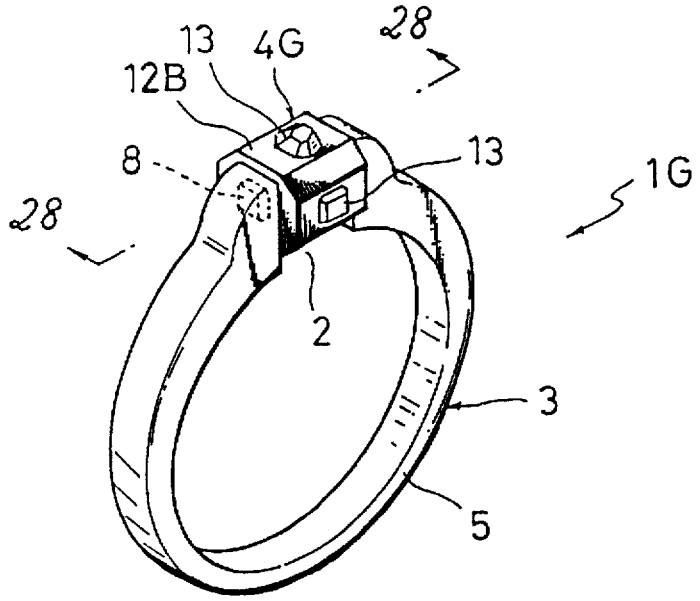
FIG. 27 is a perspective view showing the eighth embodiment of the present invention.
Figure 28:
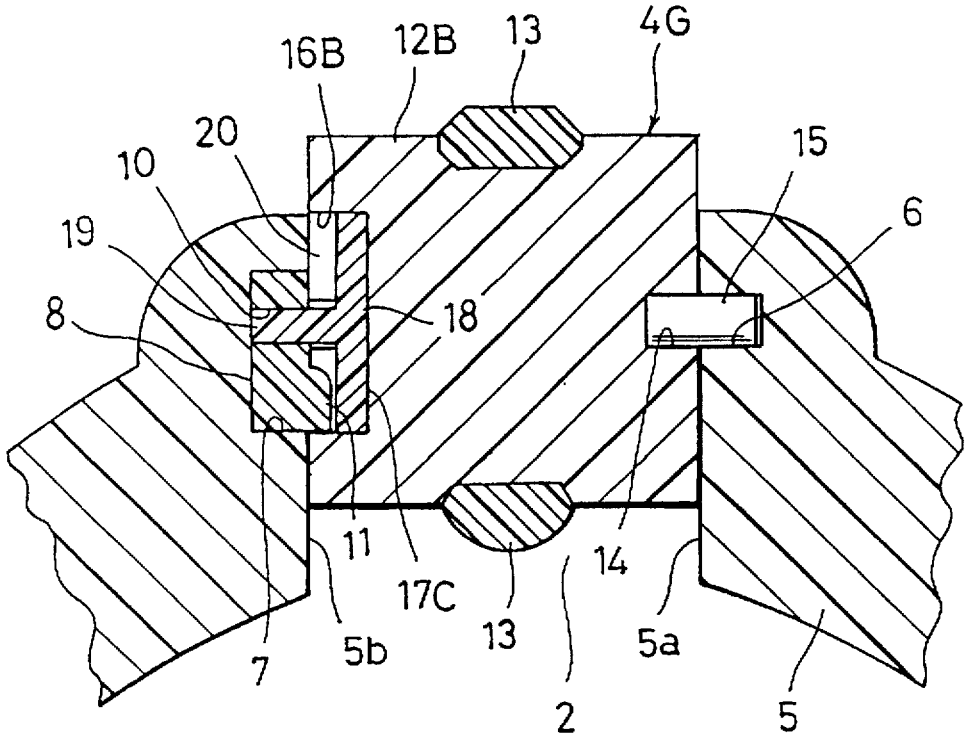
FIG. 28 is an expanded sectional view taken through line 28—28 shown in FIG. 27.
Figure 29:
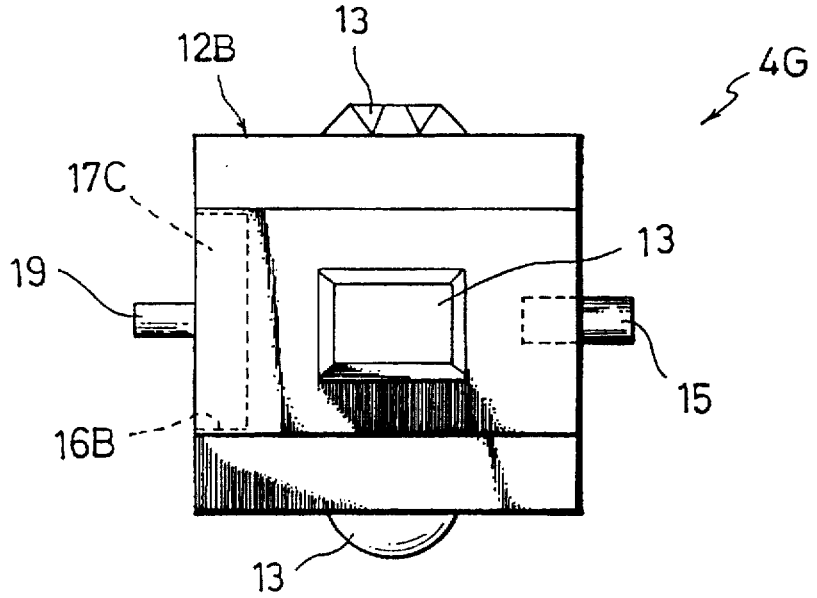
FIG. 29 is a front view of a body of revolution showing the eighth embodiment of the present invention.
Figure 30:
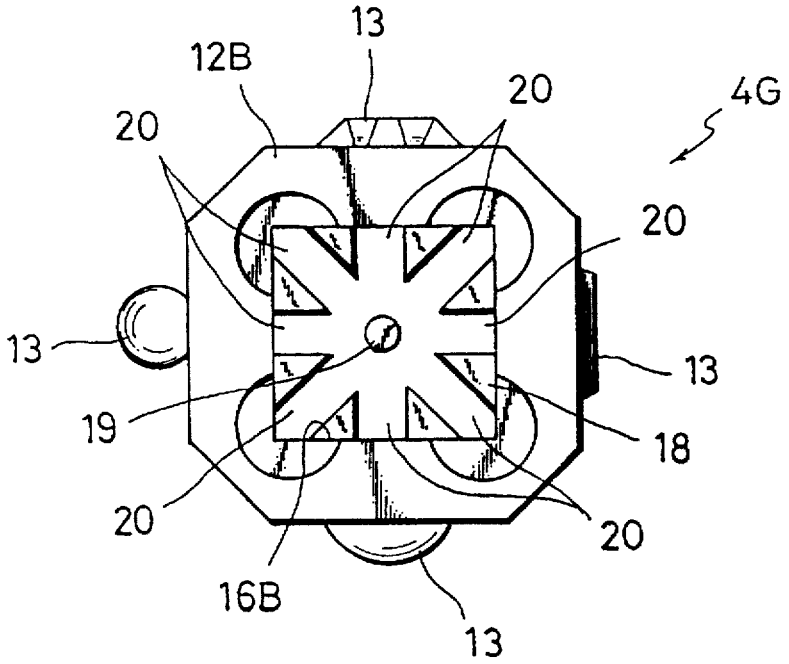
FIG. 30 is a side view of a body of revolution showing the eighth embodiment of the present invention.

FIGS. 21 to 22 illustrate the sixth embodiment of the present invention which is distinguished from the second embodiment by the fact that the support member assembly 3 is replaced with another like assembly 3E and the body of revolution assembly 4 is replaced with another like assembly 4E. The support member assembly 3E is fixed to the axle member 17A, imbedded in the concave part 7 in the support member 5. In addition, the body of revolution assembly 4E is fixed to the bearing member assembly 8A, imbedded in the concave part 16 of the body of revolution 12. Accordingly, a personal ornament 1E with the support member assembly 3E and the body of revolution assembly 4E according to the sixth embodiment will provide the same function as of the first embodiment.

Moreover, in this sixth embodiment, the body of revolution assembly may be used it which is formed one of bearing hole 6 at the body of revolution 12, and fixed to one of axle 15 into the support member 5 by insertion with pressing.

FIGS. 23 to 26 illustrate the seventh embodiment of the present invention which is distinguished from the first embodiment by the fact that the body of revolution 12 is replaced with another like assembly 12A and the body of revolution assembly 4 is replaced with another like assembly 4F. The body of revolution 12A is configured with three faces, the outwardly circumferential part of a shape of which is defined by planing off the corners of a regular triangular prism. The body of revolution assembly 4F is fixed to the axle member 17B in inlaid condition. This axle member 17B includes six pieces of engagement slots 20, 20, 20, 20, 20 and 20 arranged at every sixty degrees of a concave part 16A. This concave part 16A is formed in the other side face of the body of revolution 12A. Accordingly, a personal ornament IF is shaped to present three faces of the body of revolution 12A and the body of revolution assembly 4F according to the seventh embodiment will provide the same function as of the first embodiment.

FIGS. 27 to 30 illustrate the eighth embodiment of the present invention which is distinguished from the first embodiment by the fact that the body of revolution 12 is replaced with another like assembly 12B and the body of revolution assembly 4 is replaced with another like assembly 4G. The shape of the body of revolution 12B has four faces, the outward circumferential part being of a shape defined by planing off the comers with a regular four sided prism. The body of revolution assembly 4G is fixed to laying to axle member 17C. This axle member 17C is formed with eight pieces of engagement slots 20, 20, 20, 20, 20, 20, 20 and 20 arranged at every forty five degrees of a concave part 16B. This concave part 16B is formed in the other side of the body of revolution 12B. Accordingly, a personal ornament 1G is provided with a shape having four faces of the body of revolution 12A and the body of revolution assembly 4G according to the eighth embodiment will provide the same function as of the first embodiment.

Figure 31:
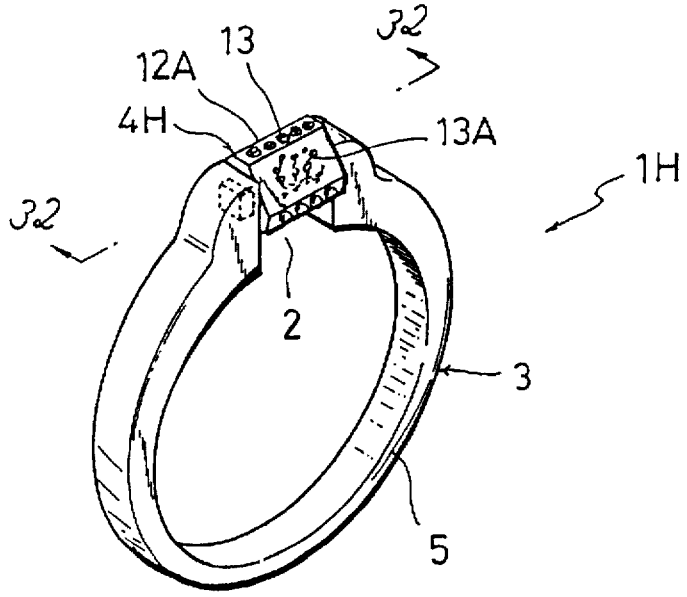
FIG. 31 is a perspective view showing the ninth embodiment of the present invention.
Figure 32:
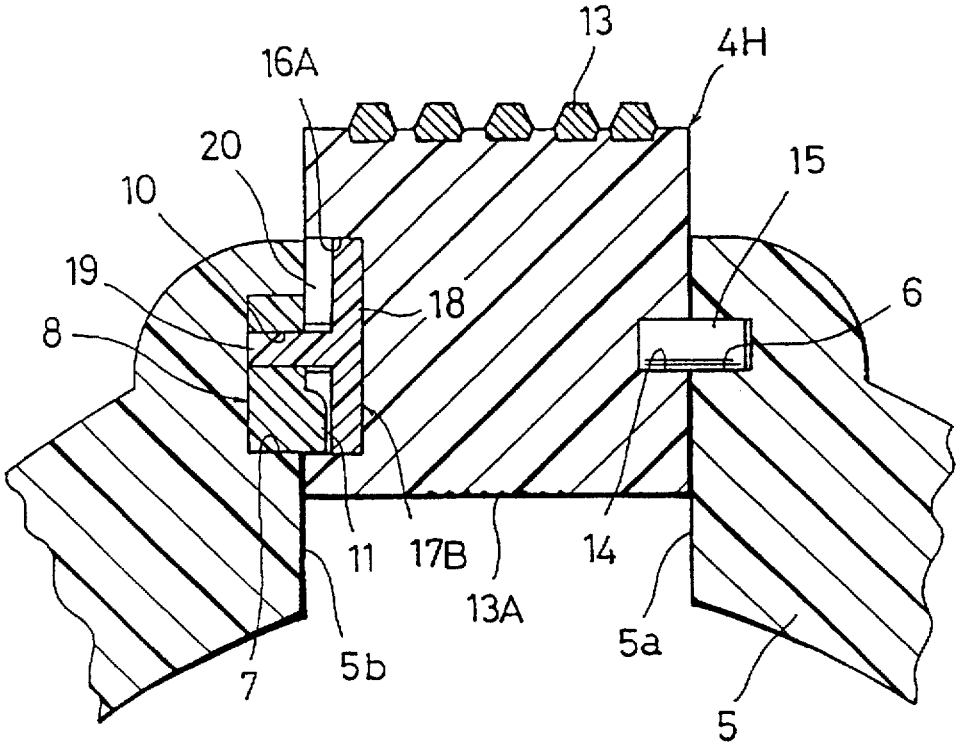
FIG. 32 is an expanded sectional view taken through line 32—32 shown in FIG. 31.
Figure 33:
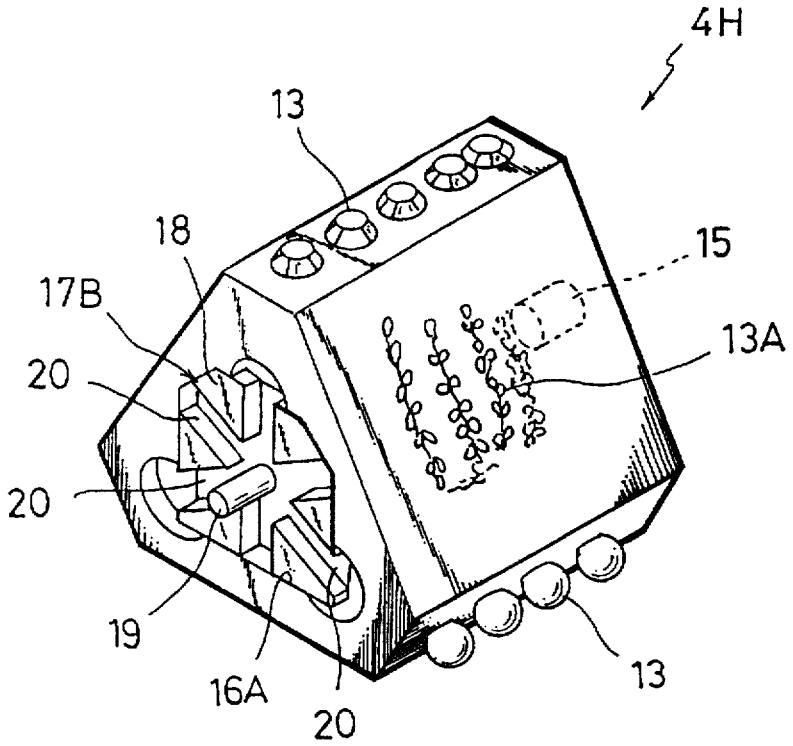
FIG. 33 is a perspective view of a body of revolution showing the ninth embodiment of the present invention.

FIGS. 31 to 33 illustrate the ninth embodiment of the present invention which is distinguished from the seventh embodiment by the fact that the body of revolution assembly 4 is replaced with another like assembly 4H. The body of revolution assembly 4H comprises a body of revolution 12A with the shape of a triangular prism planed off at the comers having the decorative parts 13A, 13A and 13A including decorated figures, and the body of revolution assembly 4H formed with decorative parts 13, 13 and 13 including the gemstones or pearl on the planed comers. Accordingly, a personal ornament 1H with the body of revolution assembly 4H according to the ninth embodiment will provide the same function as of the seventh embodiment.

Figure 34:
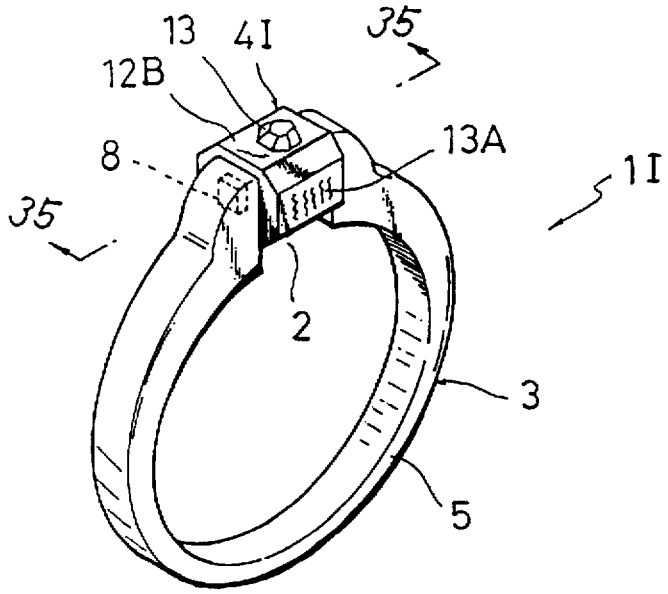
FIG. 34 is a perspective view showing the tenth embodiment of the present invention.
Figure 35:
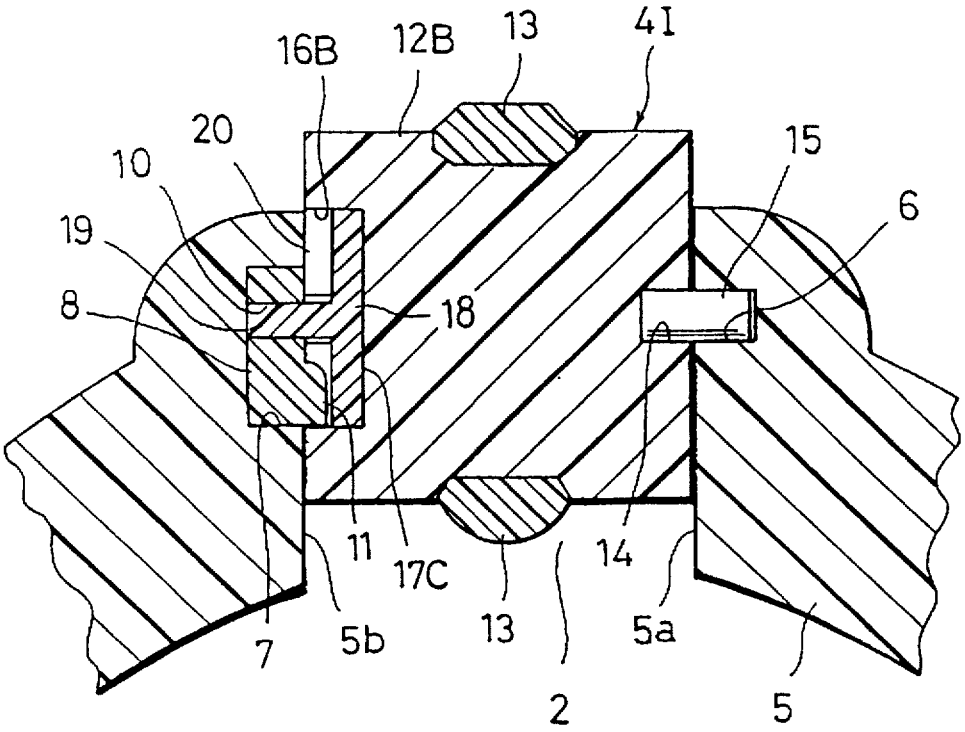
FIG. 35 is an expanded sectional view taken through line 35—35 shown in FIG. 34.
Figure 36:
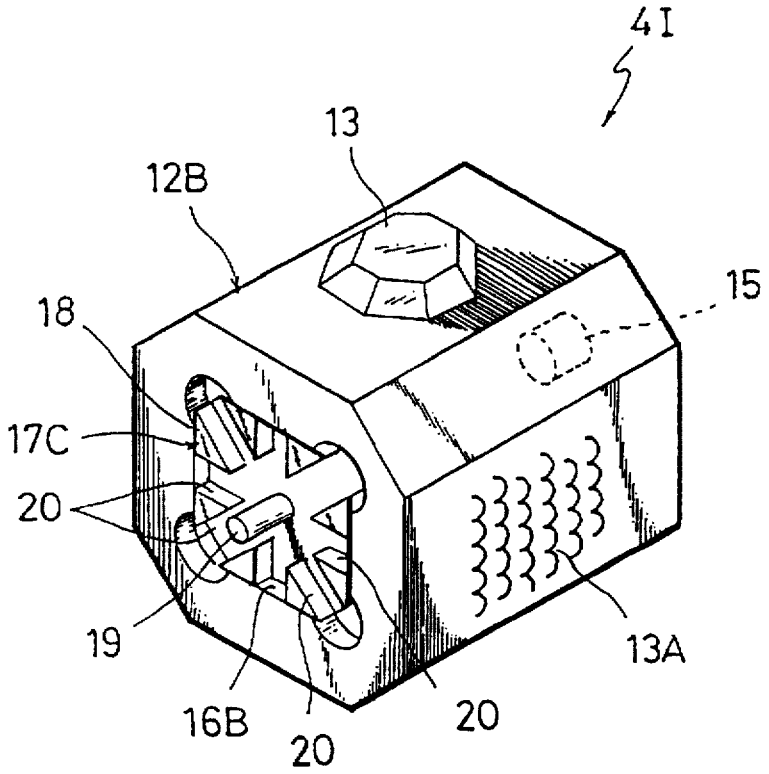
FIG. 36 is a perspective view of a body of revolution showing the tenth embodiment of the present invention.

FIGS. 34 to 36 illustrate the tenth embodiment of the present invention which is distinguished from the eighth embodiment by the fact that the body of revolution assembly 4 is replaced with another like assembly 4I. The body of revolution assembly 4I comprises the body of revolution 12B in which is formed the ornament parts 13A, 13A including decorated figures in both side faces thereof and the ornament parts 13, 13 including gemstones and pearl with upward and downward faces thereof. Accordingly, a personal ornament 1I with the body of revolution assembly 4I according to the tenth embodiment will provide the same function as of the eighth embodiment.

Figure 37:
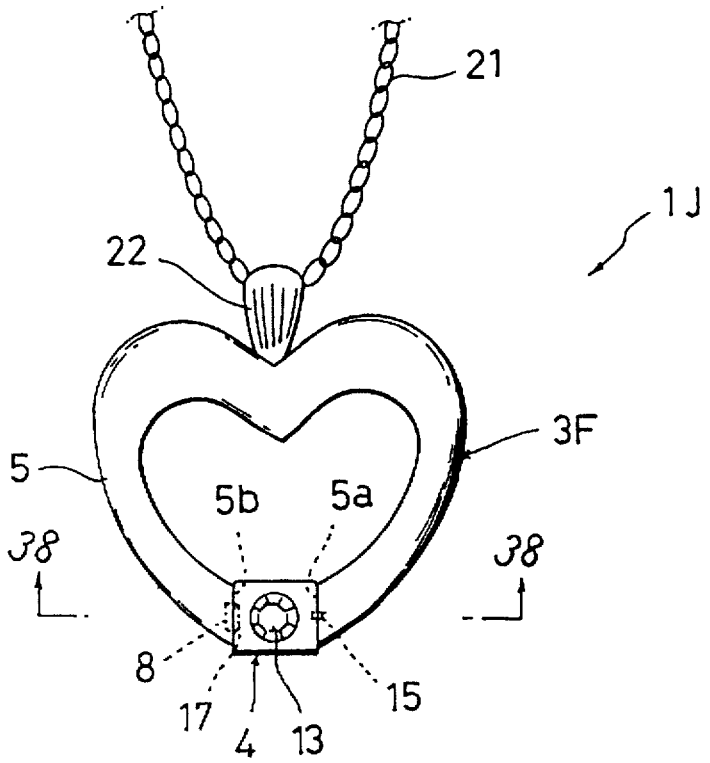
FIG. 37 is a perspective view showing the eleventh embodiment of the present invention.
Figure 38:
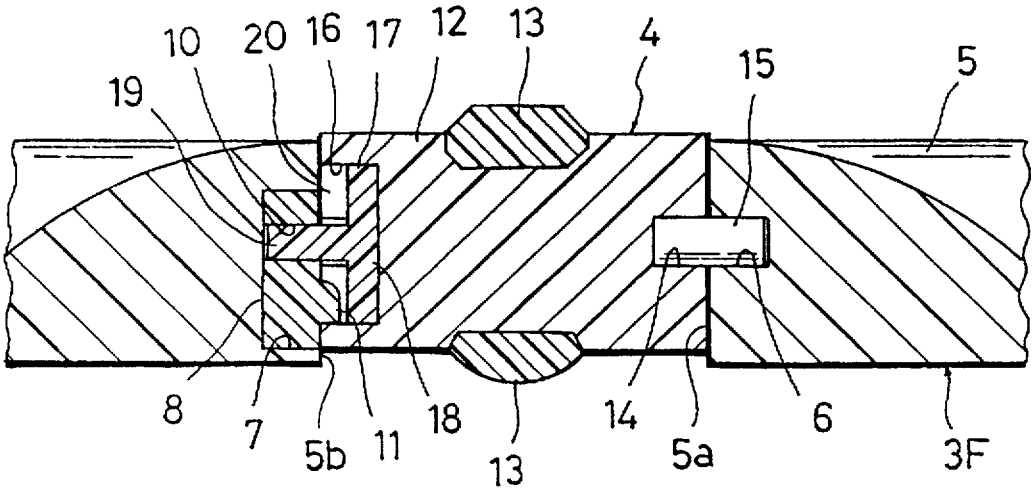
FIG. 38 is an expanded sectional view taken through line 38—38 shown in FIG. 37.

FIGS. 37 to 38 illustrate the eleventh embodiment of the present invention which is distinguished from the first embodiment by the fact that the support member assembly 3 is replaced with another like assembly 3F. The support member assembly 3F is formed in the shape of a heart shaped ring. Also it is fixed to the means for mounting 22 to mount on the hanging 21 which includes a chain. Accordingly, a personal ornament 1J with the support member assembly 3F according to the eleventh embodiment is suited to use as a necklace and pendant.

Figure 39:
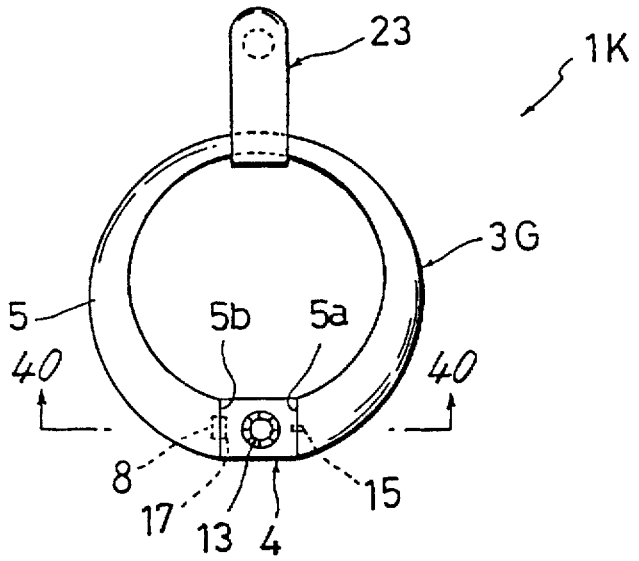
FIG. 39 is a perspective view showing the twelfth embodiment of the present invention.
Figure 40:
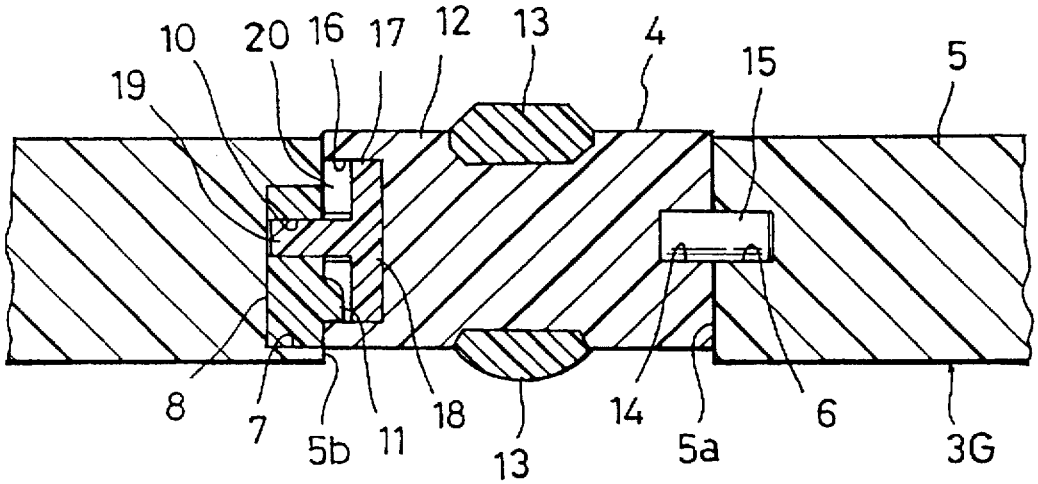
FIG. 40 is an expanded sectional view taken through line 40—40 shown in FIG. 39.

FIGS. 39 to 40 illustrate the twelfth embodiment of the present invention which is distinguished from the first embodiment by the fact that the support member assembly 3 is replaced with another like assembly 3G. The support member assembly 3G is formed as the base body of earring. Moreover, means for mounting 23 is provided to clip the earring on the earlobe and is fixed to the support member 3G. Accordingly, a personal ornament 1K with the support member assembly 3G according to the twelfth embodiment is suited to use as an earring.

Figure 41:
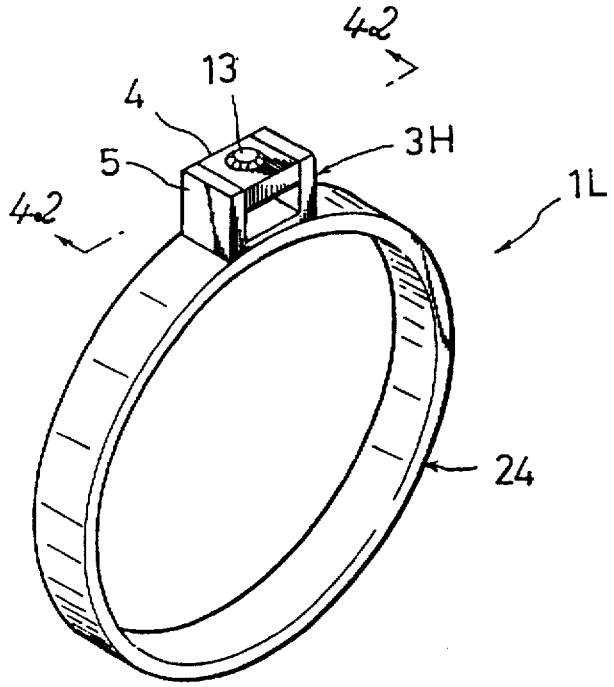
FIG. 41 is a perspective view showing the thirteenth embodiment of the present invention.
Figure 42:
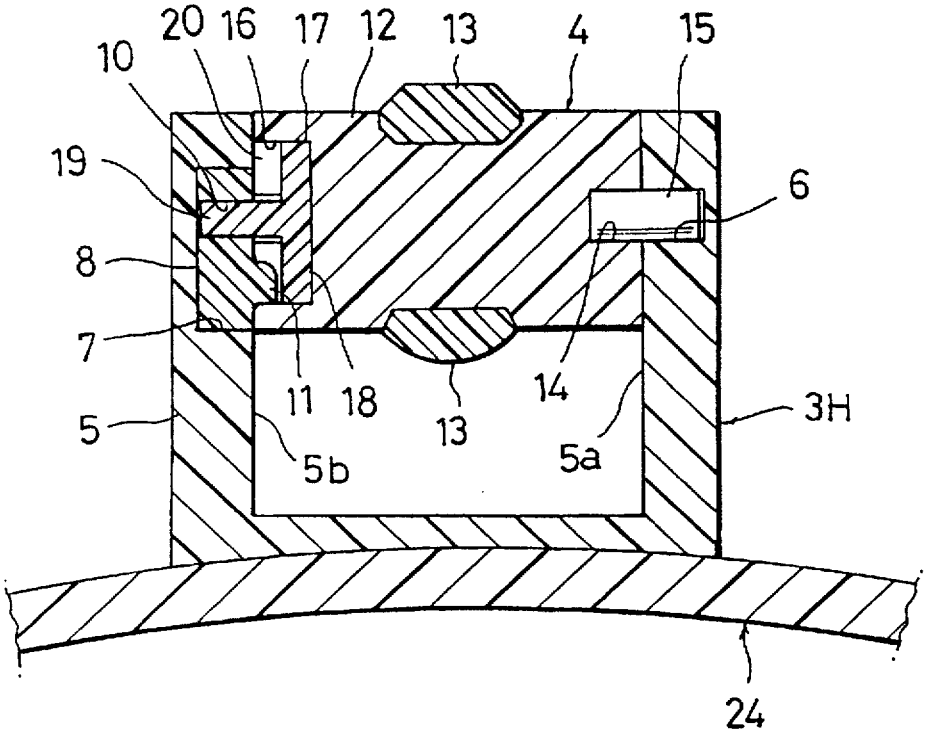
FIG. 42 is an expanded sectional view taken through line 42—42 shown in FIG. 41.

FIGS. 41 to 42 illustrate the thirteenth embodiment of the present invention which is distinguished from the first embodiment by the fact that the support member assembly 3 is replaced with another like assembly 3H. The support member assembly 3H comprises a ring member 24 to which the support member 5 is fixed. Accordingly, a personal ornament 1L with the support member assembly 3H according to the thirteenth embodiment is suited to use as a bracelet.

Figure 43:
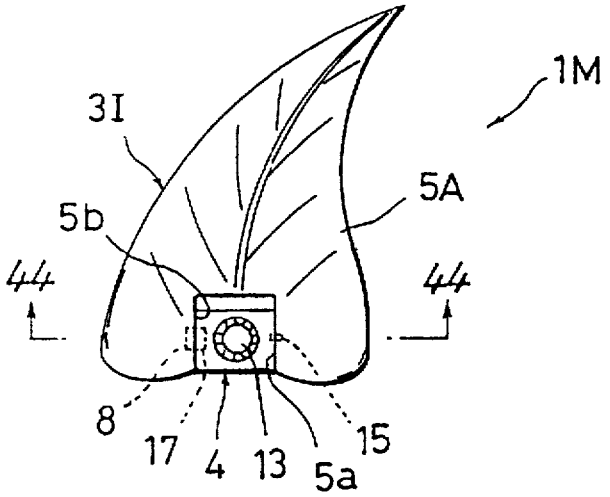
FIG. 43 is a perspective view showing the fourteenth embodiment of the present invention.
Figure 44:
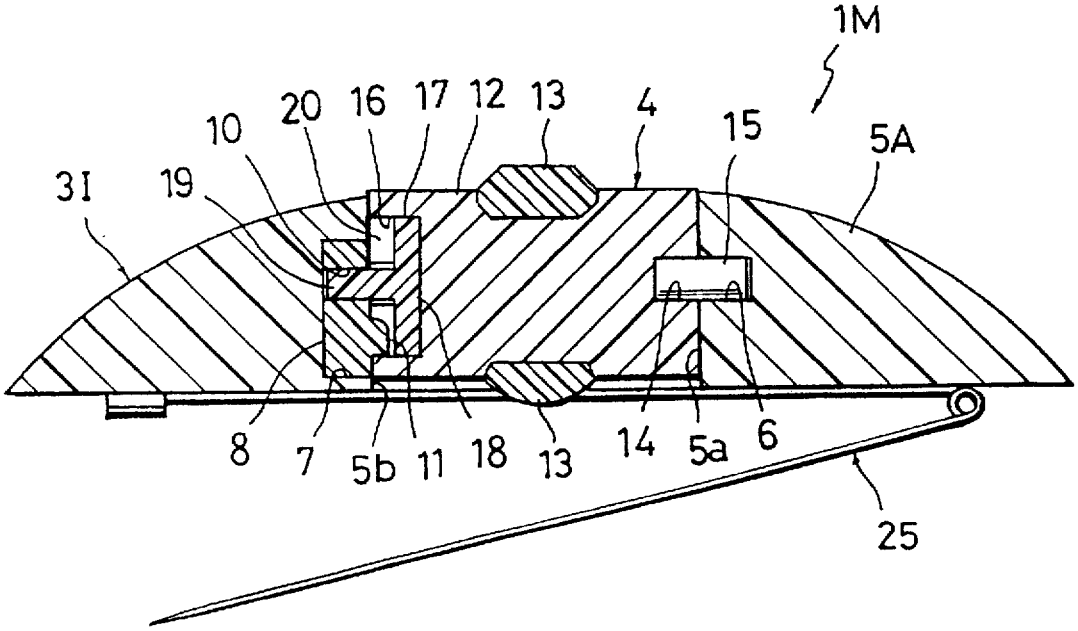
FIG. 44 is an expanded sectional view taken through line 44—44 shown in FIG. 43.

FIGS. 43 to 44 illustrate the fourteenth embodiment of the present invention which is distinguished from the first embodiment by the fact that the support member assembly 3 is replaced with another like assembly 31. The support member 5A is formed at the base body of brooch. Moreover, the support member assembly 31 comprises the support member 5A fixed to the means for mounting 25 on the back face of the support member 5A. Accordingly, a personal ornament 1M with the support member assembly 31 according to the fourteenth embodiment is suited to use as a brooch.

Figure 45:
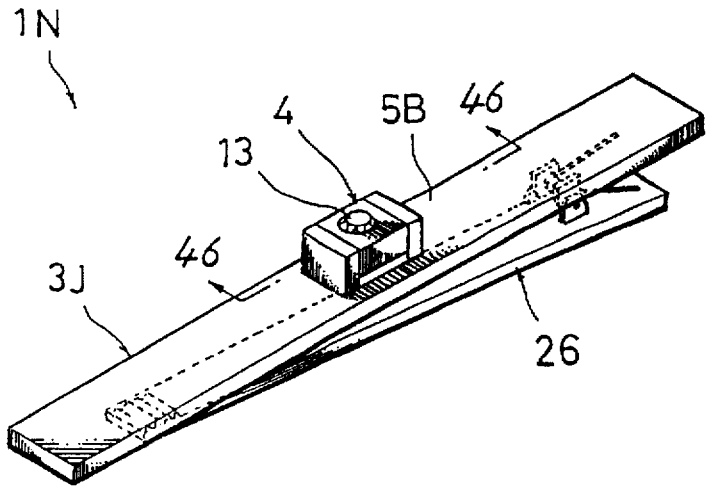
FIG. 45 is a perspective view showing the fifteenth embodiment of the present invention.
Figure 46:
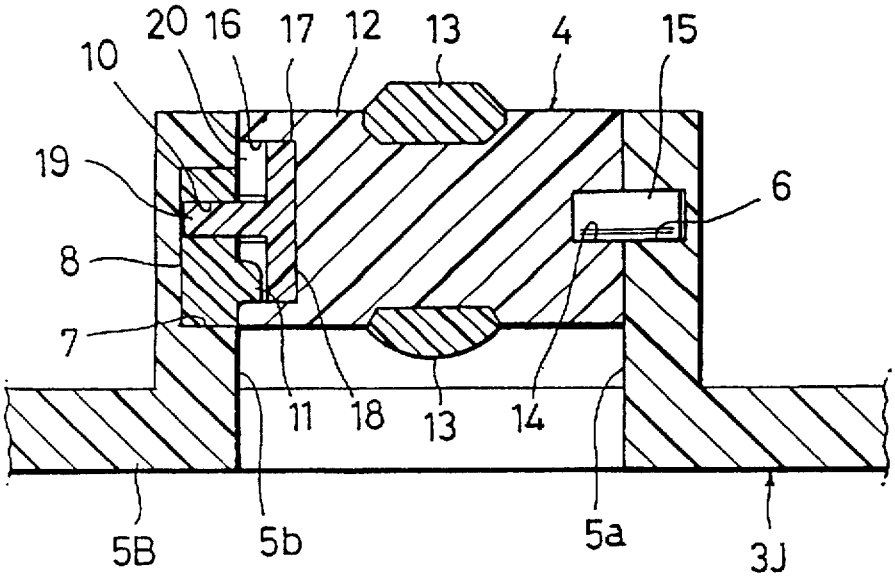
FIG. 46 is an expanded sectional view taken through line 46—46 shown in FIG. 45.
Figure 47:
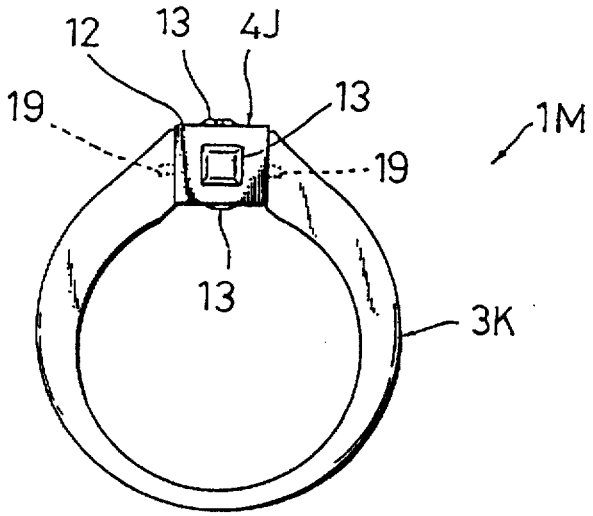
FIG. 47 is a front view showing the sixteenth embodiment of the present invention.
Figure 48:
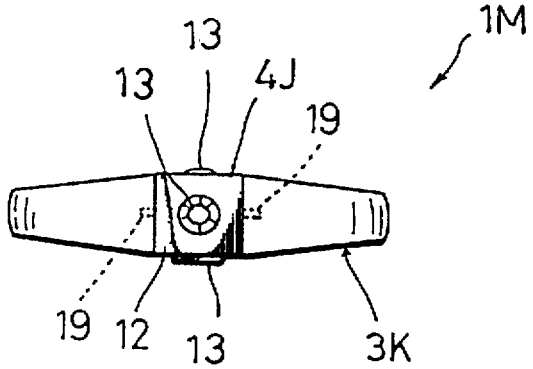
FIG. 48 is a plan view showing the sixteenth embodiment of the present invention.
Figure 49:
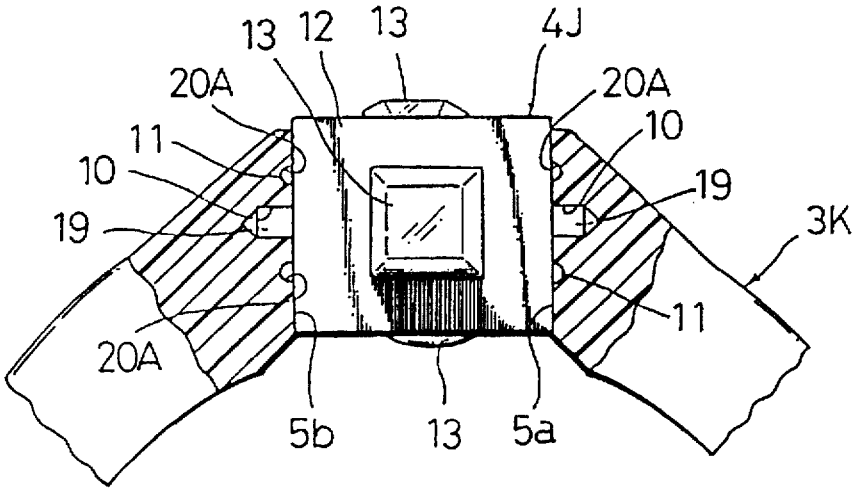
FIG. 49 is a partially sectional view of main part showing the sixteenth embodiment of the present invention.
Figure 50:
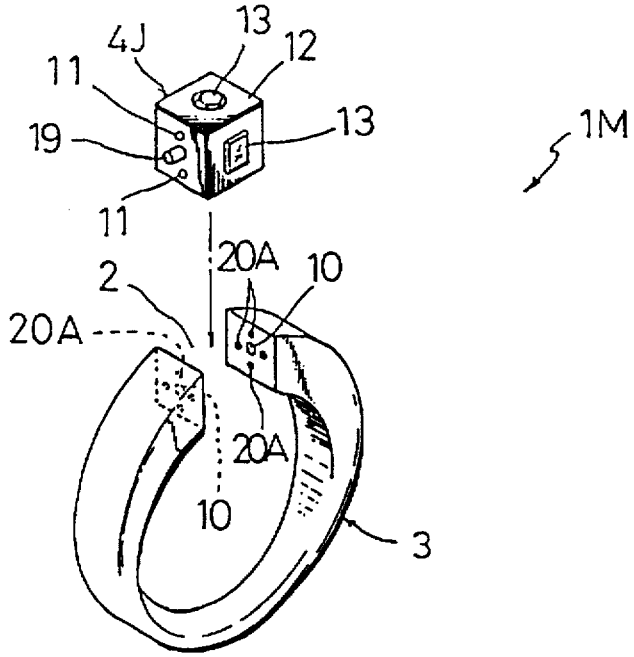
FIG. 50 is an exploded perspective view showing the sixteenth embodiment of the present invention.

FIGS. 45 to 46 illustrate the fifteenth embodiment of the present invention which is distinguished from the first embodiment by the fact that the support member assembly 3 is replaced with another like assembly 3J. The support member 3J comprises the support member 5B is shaped as the support plate of a tie holder and includes means for holding 26 on back face of the support member 5B. Accordingly, a personal ornament IN with the support member assembly 3J according to the fifteenth embodiment is suited to use as tie holder.

Moreover, in this embodiment of the present invention, a personal ornament 1N may be used as cuff links in order that the support member formed with the shape of a base plate on them.

FIGS. 47 to 50 illustrate a sixteenth embodiment of the present invention which is distinguished from the first embodiment by the fact that the personal ornament comprises a support member assembly 3K and a body of revolution 4J. The support member assembly 3K comprises bearing holes 10, 10 at both ends of opening parts thereof and the arresting hole 20 of a hemispherical concave shape at an outward circumferential part of the bearing hole 10 and 10. Moreover, the body of revolution 4J comprises axles 19, 19 which are rotatably supported to the bearing holes 10, 10 at both end parts of the body of revolution 4J and the arresting projections 11, 11 engage each arresting projection 20A, 20A, 20A, 20A at an outward circumferential part of the axles 19, 19. Accordingly, a personal ornament 1M in which the support member 3K and body of revolution 4J include the bearing hole 10, the arresting holes 20A, 20A, 20A, and 20A and the axle 19 and arresting projection 11 formed directly thereon may be provided according to the sixteenth embodiment of the present invention.

As set forth above, the advantages of the present invention are as follows:

(1) Since a personal ornament comprises a support member of a ring shape made of precious metal material having elasticity in which is formed an opening part formed conveniently by cutting off a part thereof; a body of revolution having at least two faces rotatably mounted at the opening part of the support member; an ornament part, each face of the body of revolution having the gemstones or illustration arranged; a bearing hole or axle being formed substantially in the center of both ends of the opening parts at the support member; and an axle or bearing hole being provided for rotational mounting, the bearing hole or axle which are formed substantially in the center of both ends of the body of revolution, a personal ornament can be used which is placed where the ornament part rotates to visible position.

Therefore, it can be used to change the face of the ornament part at the whim of the user.

(2) As discussed above, since the visible ornament part can be changed by rotating the body of revolution, it can be used over a long period of time without losing the user's interests.

(3) As discussed above, since the body of revolution simply rotates, it can be used by everyone easily and comfortably.

(4) Since a personal ornament comprises a support member of a ring shape made of precious metal material having elasticity in which is formed an opening part formed conveniently by cutting off a part thereof; a body of revolution having at least two faces and being rotatably mounted at the opening part there of; an ornament part, each face of the body of revolution having gemstones or illustration arranged; a bearing hole or axle being formed substantially in the center of both ends of the opening part at the support member; an axle or bearing hole being provided for rotational mounting, the bearing hole or axle being formed in the center of both ends of the body of revolution; one or more arresting projections which are fixed to the body of revolution at fixed positions, the body of revolution having formed thereon in an outward circumferential part of the bearing hole or axle at least one end of opening part at the support member or an arresting projection having the same number of faces of the body of revolution; and an arresting hole or one or more arresting projections on the body of revolution which are arrested by the arresting projection or arresting hole formed in the end part corresponding to the arresting projection or the arresting hole with the body of revolution, whereby the body of revolution can be fixed by the arresting projection and the arresting hole at a selected position.

Therefore, it can be used in the same manner as a usual personal ornament.

(5) as discussed above, since a bearing member and an axle member are fixed to the support member or the body of revolution, the bearing member and axle member can be made of a wear resistant material thereby enhancing the durability and avoiding potential problems such as unsteadiness during use and failure to remain in the fixed position.

What is claimed is:

1. A personal ornament comprising:

a ring-shaped support member comprised of a precious metal which demonstrates elasticity, said ring shaped support member including a structure, a cutout portion of which defines an opening part;

a body of revolution rotatably mounted at said opening part of said support member, said body of revolution having at least two faces;

a decorative part including gemstones or decorated figures arranged at each face of said body of revolution;

a support bearing hole or a support axle being provided in each of both ends of structural portions of said ring shaped member defining a boundary of said opening part;

a revolution axle or a revolution bearing hole for corresponding engagement with said support bearing hole or said support axle respectively to permit relative rotation therebetween, said revolution axle or said revolution bearing being formed on, and approximately in the center of, opposed ends of said body of revolution;

at least one support arresting hole or at least one arresting projection which is fixed to said support member circumferentially outward of said support bearing hole or said support axle, each of said at least one support arresting hole or said at least one support arresting projection being of a number at least the same as a number of faces of said body of revolution;

at least one revolution arresting hole or at least one revolution arresting projection formed on the body of revolution which are cooperatively arrested by a corresponding one of said at least one support arresting projection or said at least one support arresting hole respectively being formed at an end part in corresponding alignment with said at least one support arresting projection or said at least one support arresting hole; and a bearing member comprising a structure defining said support bearing hole or said support axle for rotatably engaging said revolution axle or said revolution bearing hole of said body of revolution, respectively, said support member including structure on an end part adjacent said opening part defining a concave part, said bearing member being fixedly embedded into said concave part, said bearing member further comprising structure defining said at least one support arresting projection or said support arresting hole for engaging said at least one revolution arresting hole or said revolution arresting projection of said body of revolution, respectively.

2. A personal ornament as defined in claim 1, wherein said support member is formed in a shape to be put on a person's finger.

3. A personal ornament as defined in claim 1, wherein said body of revolution is formed in a rectangular shape.

4. A personal ornament comprising:

a ring-shaped support member comprised of a precious metal material demonstrating elasticity, said ring shaped support member including a structure, a cut out portion of which defines opening part;

a body of revolution rotatably mounted at said opening part of said support member, said body of revolution having at least two faces;

a decorative part including gemstones or decorated figures arranged at each face of said body of revolution;

a support bearing hole or a support axle being provided in an approximate center of each of both ends of structural portions of said ring-shaped support member defining a boundary of said opening part;

a revolution axle or a revolution bearing hole for corresponding engagement with said support bearing hole or said support axle respectively to permit relative rotation therebetween, said revolution axle or said revolution bearing hole being disposed on, and approximately in the center of, opposed ends of said body of revolution;

at least one support arresting hole or at least one arresting projection which is fixed to said support member circumferentially outward of said support bearing hole or said support axle, each of said at least one support arresting hole or said at least one support arresting projection being of a number at least the same as a number of faces of said body of revolution;

at least one revolution arresting hole or at least one revolution arresting projection formed on the body of revolution which are cooperatively arrested by a corresponding one of said at least one support arresting projection or said at least one support arresting hole respectively being formed at an end part in corresponding alignment with said at least one support arresting projection or said at least one support arresting hole; and a bearing member comprising a structure presenting said revolution axle or said revolution bearing hole for rotatably engaging a corresponding one of said support bearing hole or said support axle formed in an end part of said support member adjacent said opening part, said revolution member including a structure at an end thereof defining a concave part, said bearing member being fixedly embedded into said concave part, said bearing member further comprising a structural configuration defining said at least one revolution arresting hole or said revolution arresting projection for engaging said at least one support arresting projection or said at least one support arresting hole, respectively.

5. A personal ornament as defined in claim 4, wherein said support member is formed in a shape to be put on a person's finger.

6. A personal ornament as defined in claim 4, wherein said body of revolution is formed a in rectangular shape.

7. A personal ornament comprising:

a support member including a partially encircling structure terminal ends of which define an opening bounded by inwardly disposed end faces of said support member;

a body of revolution;

mounting means for rotatably mounting said body of revolution to said support member between said inwardly disposed end faces thereof, said body of revolution presenting at least two faces which may be selectively outwardly directed by mounted rotation of said body of revolution;

said mounting means including cooperating structure carried on said support member and said body of revolution;

said body of revolution or at least one of said end faces including a structural configuration defining a cavity therein; and a bearing member fixedly receivable in said cavity, at least a portion of said mounting means being included as part of said bearing member.

8. The personal ornament according to claim 7, further comprising:

means for maintaining a desired incremental rotational orientation of said body of revolution.

9. The personal ornament according to claim 8, wherein said means for maintaining a desired incremental rotational orientation of said body of revolution are at least partially included in said bearing member.

10. The personal ornament according to claim 8, wherein:

said mounting means include a combination of an axle and a receiving hole, a one of which is disposed on said support structure and a remaining one of which is cooperatively disposed on said body of revolution; and said means for maintaining a desired incremental rotational orientation of said body of revolution include a combination of an arresting projection and at least one revolution arresting hole, a one of which is disposed on said support structure and a remaining one of which is cooperatively disposed on said body of revolution.

11. The personal ornament according to claim 7, wherein said bearing member is comprised of a material demonstrating greater durability than another material comprising said support structure.

12. The personal ornament according to claim 10, wherein said material of said bearing member is titanium or stainless steel, and said another material of said support structure is a precious metal or a plated metal.

* * * * *